US006399924B1

(12) United States Patent
Cai

(10) Patent No.: US 6,399,924 B1
(45) Date of Patent: Jun. 4, 2002

(54) COOKTOP HYGIENE DEVICE AND METHOD

(76) Inventor: Edward Zhihua Cai, 4767 NW. Jeanice Pl., Corvallis, OR (US) 97330

( * ) Notice: Subject to any disclaimer, the term of this patent is extended or adjusted under 35 U.S.C. 154(b) by 0 days.

(21) Appl. No.: 09/613,265

(22) Filed: Jul. 10, 2000

(51) Int. Cl.[7] ..... H05B 3/68; F24C 15/10

(52) U.S. Cl. ..... 219/443.1; 219/455.11; 126/211

(58) Field of Search ..... 219/443.1, 451.1, 219/452.11, 455.11, 455.12; 126/211, 217, 218, 39 M

(56) References Cited

U.S. PATENT DOCUMENTS

| | | | | | |
|---|---|---|---|---|---|
| 727,251 | A | * | 5/1903 | Allen | 126/211 |
| 1,000,185 | A | * | 8/1911 | Melton | 126/211 |
| 1,710,023 | A | * | 4/1929 | Hoffman | 126/211 |
| 3,490,123 | A | * | 1/1970 | Clark | 126/211 |
| 4,045,606 | A | * | 8/1977 | Kalkowski | 219/445.1 |
| 4,564,485 | A | * | 1/1986 | Eschner et al. | 264/30 |
| 5,353,781 | A | * | 10/1994 | Calvillo | 126/29 M |
| 5,447,097 | A | * | 9/1995 | Rhee | 99/450 |
| 6,044,834 | A | * | 4/2000 | Zappetti | 126/39 M |

* cited by examiner

*Primary Examiner*—Sang Paik

(57) ABSTRACT

A cooktop hygiene device removably mountable to a cooktop for collecting food sputterings or spillings and preventing such sputterings or spillings from contaminating the cooktop comprises a plate-like structure, which can be flexible or rigid, having an upper surface adapted to receive the spillings or sputterings and a lower surface adapted to interface with the cooktop surface, and a plurality of openings on the plate-like structure to receive the heaters on the cooktop and to allow a user to place a cookware or utensil on the heaters. A fold facilitator is provided on the plate like structure to facilitate the folding of the device to fit into a dishwasher. A plurality of drip pans secured to the plate-like structure is provided for catching the food and liquid spillings or sputterings. The plurality of openings may be covered by heater covers to provide cooking zones on the plate-like structure to engage with the heaters and conduct heat from the heaters to cookware on the cooking zones. Methods for preventing the cooktop from being contaminated by food spillings or sputterings using a cooktop hygiene device are provided.

50 Claims, 9 Drawing Sheets

A plurality
of holes
drip Pan not needed
or above it

COOKTOP HYGIENE DEVICE AND METHOD

FIELD OF THE INVENTION

The invention relates to a device and method for maintaining cooktops such as electric and gas ranges in a clean condition. More particularly, the invention relates to a device and method for collecting food and liquid sputterings or spillings and preventing such sputterings or spillings from contaminating the cooktops.

BACKGROUND OF THE INVENTION

Currently, to clean cooktops such as electric and gas ranges or stoves, consumers have to manually wipe the food and liquid sputterings or spillings from the cooktop surface with cloth, sponge or paper. In addition, the food and liquid sputterings or spillings on the cooktop surface close to the heaters such as gas or electrical burners, if not removed timely or completely, may become baked on and the resulting baked-on food soils can only be removed with the assistance of special cleaning compounds and chemicals. As a result, cooktop cleaning has been ranked by consumers as the most labor-intensive and undesired work in kitchens along with food preparation and the dish washing.

The baked-on food soils cause black-vanish-like coatings, making the cooktop look non-hygienic and visually unappealing. The cleaning of the cooktop surface with cleaning compounds, which are sometimes abrasive, scratches and mars the cooktop surface, making the cooktop look old and visually unappealing. New advancements in cleaning compounds have been made in an effort to improve the cleaning of the cooktop surface but the results have not proven very satisfactory. Significant progresses have also been made on ranges with smooth, easy-to-clean glass-ceramic surfaces as shown in U.S. Pat. No. 3,987,275 to Hurko, U.S. Pat. No. 4,740,664 to Payne and Welle, U.S. Pat. No. 4,755,655 to Reiche et al., and U.S. Pat. No. 5,968,371 to Deo and Griffiths. Such smooth-surface cooktops, although relatively easier to be cleaned than the traditional gas and electric rages, still require labor-intensive cleaning and suffer from the difficult-to-remove baked-on food soil problem (U.S. Pat. No. 4,251,716 to Lewis and Hurko). In addition, such smooth glass-ceramic surface ranges are too expensive for average consumers.

It is therefore an object of the invention to provide a product to free consumers from the labor-intensive and unpleasant work of cleaning cooktops.

It is a further object of the invention to provide consumers a device that prevents the food and liquid spillings or sputterings from staining the cooktop surfaces and is washable by a dishwasher or a wash machine.

It is a still further object of the invention to provide a product that makes it unnecessary to clean the cooktops, therefore freeing the cooktops from being scratched and marred.

It is a still further object of the invention to preserve the newness and fresh look of a cooktop for a long period of time and to elongate the life of the cooktop.

It is a still further object of the invention to provide a device that is large enough to cover a cooktop surface but is easy to store, transport, handle and wash.

It is a still further object of the invention to provide a device that covers a cooktop surface without making it inconvenient for a consumer to access the electric or gas burners of the cooktop.

It is a still further object of the invention to provide a device to convert a traditional cooktop or range into a smooth-surface cooktop to facilitate the cleaning.

It is a still further object of the invention to provide a device that covers a cooktop surface as well as covers or replace the drip pans in a traditional cooktop.

It is a still further object of the invention to provide a cooktop hygiene device whose dimension can be changed by a user to fit his or her specific cooktop.

Still other objects will become apparent after reading the accompanying drawings and description. It should be understood that the invention could still be practiced without performing one or more of the objects set forth above.

SUMMARY OF THE INVENTION

Accordingly, the invention provides a cooktop hygiene device for collecting food and liquid sputterings or spillings and preventing such sputterings or spillings from contaminating the cooktops. The device comprises a plate-like structure removably mountable onto the cooktop for preventing food and liquid spillings or sputterings from contaminating cooktop surface. The plate-like structure, which can be either flexible or rigid, comprises an upper surface adapted to receive food and liquid spillings or sputterings from cookware or utensil during food preparation process, a lower surface adapted to interface with the surface of the cooktop, a plurality of openings located on the plate-like structure to receive the heaters on the cooktop and to allow a user can place a cookware or utensil on or above a heaters for heating the content in the cookware or utensil when the cooktop hygiene device is mounted to the cooktop. A fold facilitator may be formed on said plate like structure to facilitate the folding of the plate-like structure. The cooktop hygiene device further comprises an anti-motion mechanism to prevent the plate-like structure from movement on the cooktop surface. A plurality of drip pans secured to said plate-like structure may be positioned below the heaters of the cooktop for catching food and liquid spillings or sputterings from cookware or utensil during food preparation process. The openings for receiving the heaters may be formed directly on the cooktop if the plate-like structure comprises a plate material that can be melted softened or degraded when exposed to the high heat from the heaters on the cooktop. A plurality of covers may be connected to the plate-like structure for covering the openings or heaters by hinges. The hinge may comprise an extension to position the covers away from the heaters to avoid the covers from blocking the access to the heaters when the covers are opened.

In another embodiment of the invention, the cooktop hygiene device comprises a first plate-like structure having an upper surface for receiving food and liquid spillings or sputterings from cookware or utensil during food preparation process and a lower surface adapted to interface with the surface of the cooktop, a second plate-like structure comprising an upper surface for receiving the food and liquid spillings or sputterings from cookware or utensil during food preparation process and a lower surface adapted to interface with the surface of the cooktop, and a connector for connecting the first plate-like structure to said second plate-like structure in such as way to enable a user to reduce the dimension of said cooktop hygiene device to fit into a dishwasher for cleaning the cooktop hygiene device. In one configuration, the connector comprises a flexible or bendable material or a hinge to allow a user to fold said plate-like structure. In another configuration, the connector comprises a first connection member located on the first plate-like structure and a second connection member located on the second plate-like structure to interface with the first connection structure to prevent the food or liquid spillings or sputterings from passing through said plate-like structure. In still another configuration, the connector comprises a first chamber to receive at least part of the first plate-like member and a second chamber to receive at least part of the second plate-like structure. In still another configuration, the connector comprises an expandable member such as a pleated member or an expandable material to allow a user to change the dimension of the cooktop hygiene device to fit the cooktop.

In another embodiment of the invention, the cooktop hygiene device is removably mountable to the cooktop and comprises a plate-like structure having a first surface for receiving the food and liquid spillings or sputterings from cookware or utensil during food preparation process and a second surface adapted to face the surface of the cooktop and a plurality of cooking zones on said plate-like structure for engaging with the heaters on the cooktop and for conducting heat from the heaters to cookware or utensil on or above said cooking zones. The plate-like structure is generally impermeable to the food and liquid spillings or sputterings collected on said first surface thereby preventing the food and liquid spillings or sputterings from contaminating cooktop surface. In one configuration, the plate-like structure is adapted to be anisotropic in heat conductivity so that the heat from the heaters on the cooktop is substantially confined within the cooking zones. In another configuration, the plate-like structure comprises numerous solid pieces connected to each other by narrow connectors and separated from each other by air gaps. The narrow connectors are sufficiently narrow or thin to minimize the heat conduction between the solid pieces thereby preventing or limiting the heat conduction along the surface of the cooking zones and the plate-like structure. The air gaps are made sufficiently small or filled with heat insulation materials to prevent the food or liquid spillings or sputterings to be collected on the first surface of the plate-like structure from passing through. In still another configuration, the cooktop hygiene device further comprises heat restriction zones surrounding the cooking zones for preventing or limiting the heat flow from the cooking zones to the other part of said cooktop hygiene device.

The cooktop hygiene device may further comprise a raised wall around at least one of said cooking zones to convert at least one cooking zone into a cookware for cooking food. The cooktop hygiene device may further comprise air vent for providing air to the heaters if the heaters are gas heaters. The cooking zones may comprise raised or recessed structures for increasing the surface area thereby improving the heat transfer from the cooking zone to the surrounding. A coating such as a Teflon, elastomer, glass or ceramic coating may be applied to at least the surface of said cooking zones of said cooktop hygiene device.

Another aspect of the invention is a method for preventing the surface of the cooktop from being contaminated by food and liquid spillings or sputterings thereby reducing or even eliminating the need to clean the surface of the cooktop. The method comprising mounting a cooktop hygiene device comprising a plate-like structure generally impermeable to the food and liquid spillings or sputterings onto the cooktop, collecting the food and liquid spillings or sputterings from cookware or utensils during food preparation process onto the upper surface of the plate-like structure, and removing the cooktop hygiene device from the cooktop for the purpose of washing or disposing the cooktop hygiene device after the user determines that there is too much food and liquid spillings or sputterings collected on the upper surface of the plate-like structure. The method may further comprise a step of folding the plate-like structure to reduce the size of the cooktop hygiene device to fit into the dishwasher.

DESCRIPTION OF THE DRAWING

The accompanying drawing illustrates diagramatically non-limitative embodiment of the invention, as follows.

DETAILED DESCRIPTION OF THE PREFERRED EMBODIMENTS

Figure 1B:
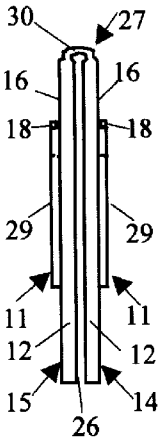
FIG. 1*b* is a front view of the cooktop hygiene device of FIG. 1 in a folded position.
Figure 1A:
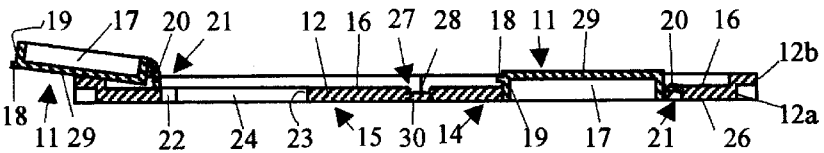
FIG. 1*a* is a sectional view along line 1*a*—1*a* of FIG. 1.

Reference will now be made in detail to the present preferred embodiments of the invention, examples of which are illustrated in the accompanying drawings. Wherever possible, the same reference numbers are used in the drawings and the description to refer to the same or like parts.

Figure 1:
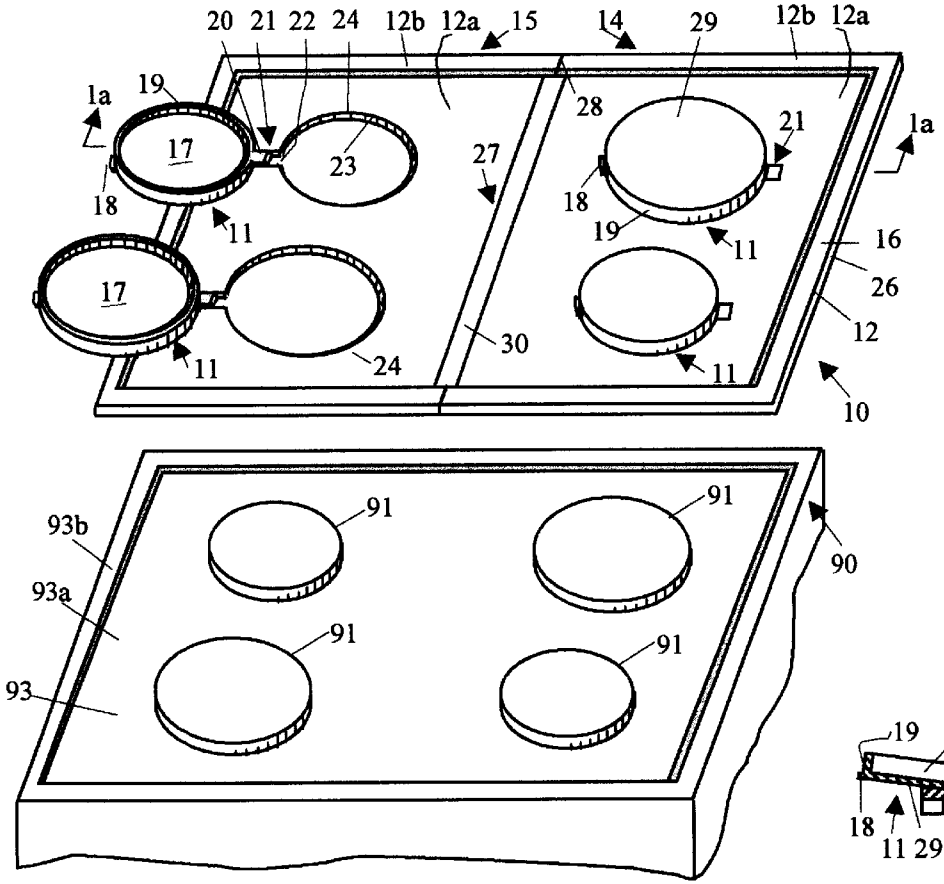
FIG. 1 is a perspective view of a cooktop hygiene device and part of a cooktop.

FIG. 1 shows part of a cooktop 90 having four gas or electric heaters (or burners) 91 located on a cooktop surface 93 comprising a recessed cooktop surface 93*a* and a raised peripheral surface 93*b* and a cooktop hygiene device 10 removably mountable to the cooktop for collecting the food and liquid sputterings or spillings from the cookware or utensils during the cooking processes. The cooktop hygiene device 10 comprises a plate-like structure 12 generally impermeable to food, thereby preventing such sputterings or spillings from reaching the cooktop surface 93. The plate-like structure 12 comprises an upper surface 16 for receiving food and liquid spillings or sputterings from cookware or utensils during food preparation processes, a lower surface 26 configured to engage with the cooktop 90 to prevent movement of the cooktop hygiene device on the cooktop, and four openings 24, each opening having an internal peripheral wall 23, dimensioned to receive the four heaters 91 on the cooktop and to allow the user to place cookware or utensils on the heaters. To fit the contour of the cooktop surface, the plate-like structure has a recessed part 12*a* dimensioned to cover the recessed cooktop surface 93*a* and a raised part 12*b* dimensioned to cover the raised peripheral surface 93*b* of the cooktop. The part of the lower surface 26 under the recessed part 12*a* of plate-like structure 12 can be in contact with the recessed cooktop surface 93*a* to reduce the movement of the cooktop hygiene device. The opening 24 on the plate-like structure 12 are dimensioned and positioned primarily according to the size and location of the heaters 91 on cooktop 90. The peripheral edge of the openings 24 may be raised approximately 0.1 to 2 cm to prevent the food or liquid sputterings or spillings from dropping or overflowing into the interior of the cooktop 90. The raised peripheral edge can be as high as the heater or the support such as grates for cookware. The plate-like structure 12 may be configured to cover the control panel of the cooktop (not shown), thus preventing the control panel from being contaminated by the sputterings or spillings, too.

The upper surface 16 is preferably made smooth and non-sticky to facilitate the cleaning or the removal of the food and liquid sputterings or spillings during manual or dishwasher washing of the cooktop hygiene device. The part of the lower surface 26 that is in contact with the cooktop surface 93 is preferably made to have sufficiently high coefficient of friction or even made sticky to limit or prevent the movement of the cooktop hygiene device on the cooktop. The recessed part 12*a* of the plate-like structure 12 may be dimensioned to fit sufficiently tightly into the recessed cooktop surface 93*a* to prevent the movement of the device. Other anti-motion mechanisms, such as magnet powders impregnated in or magnet strips attached to the plate-like structure 12, electrostatic adhesives or pressure sensitive adhesives or surface tackifiers applied to the plate-like structure, and vacuum suck cups attached to or formed on the plate-like structure, may be used to limit or prevent the movement of the cooktop hygiene device on the cooktop.

To allow the cooktop hygiene device 10 to fit into a conventional dishwasher, the device dimension must be reduced. FIG. 1*b* shows that after being removed from the cooktop, the cooktop hygiene device can be folded around a connector or fold facilitator 27, resulting in a left-hand plate-like member 15 and a right-hand plate-like member 14 of the plate-like structure 12. The folded cooktop hygiene device is small enough to fit into a conventional dishwasher. The fold facilitator 27 comprises a thin, flexible strip 30 connecting the left part 15 and right part 14 of the plate-like structure 12 into one continuous plate. The front and back sides of the raised peripheral surface 12*b* of the cooktop hygiene device are cut, as indicated by lines 28, at the fold facilitator 27 to facilitate the folding of the plate-like structure 12. The thin strip 30 may comprise the same material as the left part 15 and right part 14 of the plate-like structure or may be formed together with left part 15 and right part 14. The thin strip may also comprise materials different from the left part 15 and right part 14. The preferred materials for the thin strip 30 are flexible materials such as elastomer and thin plastics. Other types of fold facilitators or connectors, such as hinges, magnetic connectors and expandable connectors, some of which will be described in more detail later, may be used to replace the fold facilitator 27 here. It is appreciated that the fold facilitator or connector 27 becomes unnecessary if the plate-like structure is flexible and can be bent, folded or rolled to fit into a dishwasher. A side benefit of the foldability or flexibility of the plate-like structure 12 is that it enables the cooktop hygiene device to take less space during transportation, storage and on retail shelves.

The cooktop hygiene device further comprises four heater covers 11 to enable the user to close the openings 24 (refer to the two heater covers 11 at the right hand of FIG. 1) when the corresponding heaters are not in use and to open the openings 24 (refer to the two heater covers 11 at the left hand of FIG. 1) when the corresponding heaters are not use. These heater covers help preventing the food and liquid sputterings or spillings from contaminating the heaters or the drip pans below the heaters during the cooking or food preparation process. Each heater cover 11 has a side wall 19, a top wall 29 and a chamber 17 formed by the side wall and the top wall for receiving the heater 91 of the cooktop 90. The heater cover 11 Is connected to the plate-like structure 12 via a hinge 21. To insure that the heater cover 11 will not prevent a cookware or utensil from contacting the heater 91 properly, an extension 20 is used between the heater cover and the plate-like structure so that the heater cover can be sufficiently away from the opening 24. A space 22 is formed on the plate-like structure to receive the extension 20 when the heater cover 11 closes the opening 24. The heater cover 11 is dimensioned to fit into the opening 24 when it closes the opening, although it is appreciated that the heater cover can be larger than the opening 24 and as a result it rests above the plate-like structure when it is in its close position.

It is appreciated that the heater cover 11 can also be constructed to allow its top wall 29 to function as a cooking zone for conducting heat from the heater 91 to the cookware or utensil on the heater cover. In this case, the heater cover may be formed of highly heat-resistant materials such as stainless steel, cast iron, glass or ceramic materials. The top wall 29 may be configured to increase the surface area, therefore increasing the rate of heat transfer from the wall 29 to the surrounding. The faster heat transfer to the surrounding reduces the potential damage of the heater cover 11 by the heater 91. The surface area of the top wall 29 can be increased, for example, by forming raised or recessed structures such as discs, ridges or cells on the upper surface of the top wall 29. A plurality of air vents, such as holes or openings on the side wall 19, may be formed on the heater covers to provide air to the burners if the cooktop hygiene device is used for a conventional gas cooktop or range.

A handle or tab 18 is attached to or formed on the heater cover 11 for allowing the user to readily open and close the opening 24. The heater cover 11 may further comprise a locker to prevent the heater cover from free movement when it closes the opening 24, which proves to be useful during the handling and washing (e.g. in a dishwasher) of the cooktop hygiene device. The lock of the heater cover position may be achieved by the tight fit between the side wall 19 of the heater cover and the inner peripheral wall 23 of the opening 24 or by the appropriate tapering of the wall 19 and the inner wall 23 (e.g. the wall 19 of the heater cover has increasing diameter and the inner wall 23 of the opening 24 has decreasing diameter from top to bottom). The locker may also be a simple mechanical locking mechanism such as a catch and latch formed on the handle 18 and the plate-like structure 12, an adhesive applied to handle or tab 18 or the heater cover, or a magnet included in the handle or tab 18, heater cover 11 and/or the plate-like structure 12.

To insure that the cooktop hygiene device will not catch fire when it is close to or even in contact with the heater 91 when the heater is on, the plate-like structure 12 and the cover 11 of FIGS. 1 to 10 are preferably formed of non-flammable material or materials. Such non-flammable materials include most metals and their alloys, ceramic materials, glass materials, oxides, non-flammable polymers (e.g. certain plastics, rubbers and thermoset materials such as Teflon and Kevlar), polymers with flame-retardant additives, and any combinations of these materials. Typical examples are stainless steel, aluminum, highly fluorinated polymers (e.g. Teflon), substantially wholly aromatic polymers that do not produce flammable gas at over 750° F. (e.g. Kevlar, polyphenyl sulfide, polyphenyl oxide and polyphenyl quoixolines), and silicone rubbers. When polymeric material or materials are used for the plate-like structure 12 and the cover 11, high-density inorganic fillers such as glass powder, stainless steel powder, calcium fluoride, rock powder, graphite, or sand powder can be used to reduce the formation of curl, wrinkles and kinks on the plate-like structure and the heater cover. The inorganic fillers may also reduce the materials cost of the device and the flammability.

The plate-like structure 12 and heater covers 11 of the cooktop hygiene devices 10 of FIGS. 1 to 10 can be formed from sheet or film materials such as stainless steel sheet, zinc sheet, aluminum foil, Teflon film and silicone rubber sheet and from woven or non-woven materials such as stainless steel cloth (with or without Teflon or ceramic coating), glass fiber cloth and Kevlar cloth. The manufacturing processes involved may include thermoforming, metal forming, heat sealing, welding, and die or laser cutting. To prevent the exposed edges of the plate-like structures 12 and heater covers 11 shown in FIGS. 1 to 10 from injuring or cutting people, the exposed edges may be rounded, flanged, coated with softer materials such as plastics or elastomer, or made thicker than the inside areas. Such treated edges is found to greatly reduce the risk of cutting fingers when metal, glass, ceramic and other hard materials are used for the plate-like structure and heater covers. The cooktop hygiene devices 10 can also be manufactured by molding, casting or extrusion of plastic, elastomer, ceramic, glass, oxide, metal or metal alloy materials. Decorative coatings such as ink printing, porcelain enamel, paint and stamping can be provided on the surface of the plate-like structure 12 and heater covers 11 of the cooktop hygiene devices 10.

Figure 2B:
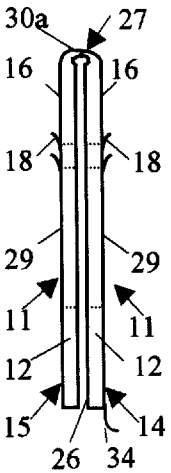
FIG. 2*b* is a front view of the alternative cooktop hygiene device of FIG. 2 in a folded position.
Figure 2A:
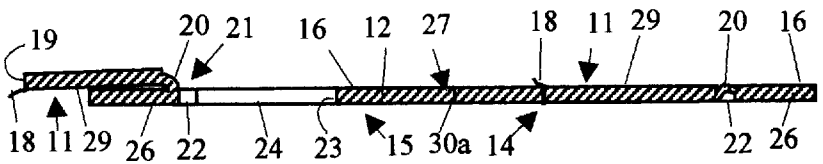
FIG. 2*a* is a sectional view along line 2*a*—2*a* of FIG. 2.
Figure 2:
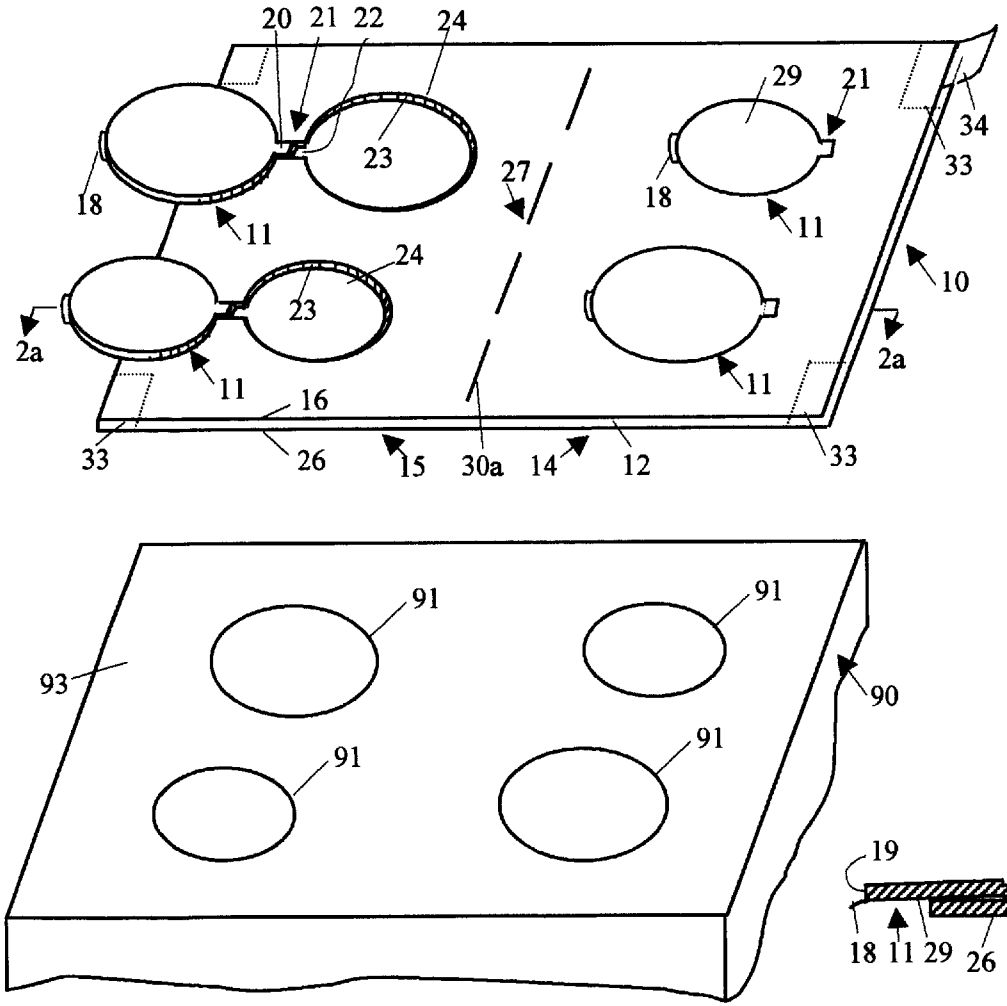
FIG. 2 is a perspective view of an alternative cooktop hygiene device and part of a cooktop.

FIGS. 2 to 2*b* show a modified version of the cooktop hygiene device of FIG. 1. This modified device has generally flat heater covers 11, compared to the relatively more complex, cup-shaped heater covers of FIG. 1, and can thus be manufactured from sheet or film or woven cloth materials by simple processes such as die cutting. Anti-motion mechanism 33 is included on at least the corners of the modified cooktop hygiene device to prevent the device from free movement after the device is mounted onto the cooktop. The anti-motion mechanism can be magnets, adhesives (such as electrostatic adhesive, pressure sensitive adhesive or tackilifiers) and vacuum suck cups attached to or formed into the plate-like structure 12. A device handle or tab 34 is located near the peripheral edge of the plate-like structure for facilitating the removal of the plate from the cooktop 90. This modified device is ideal for the cooktops, such as the smooth glass or ceramic cooktops, whose heaters are at or only slightly above the cooktop surface 93. For the traditional electric and gas cooktops whose heaters or grates are significantly above the cooktop surface 93, the extension 20 of the hinge 21 for each heater cover 11 can be made sufficiently long to allow the heater cover 11 to cover the top surface of the heaters or grates. The fold facilitator 27 comprises a plurality of cuts 30*a* near the center line of the plate-like structure to facilitate the folding of the modified device. If the film or sheet or cloth material used to form the plate-like structure is flexible enough, the fold facilitator 27 may not be needed, which further simplifies the manufacturing process and lower the cost. If the plate-like structure is formed of flexible materials, especially if of woven cloth, the cooktop hygiene device may be washed by either dishwasher or cloth wash machine.

When the manufacturing cost becomes low enough, the cooktop hygiene devices of the invention can be disposed when becoming dirty after one use, therefore completely eliminating the cleaning work related to cooktops. For disposable cooktop hygiene devices, degradable materials such as biodegradable, air-degradable, or water-degradable or light degradable materials may be used to address potential environmental concerns.

Figure 3:
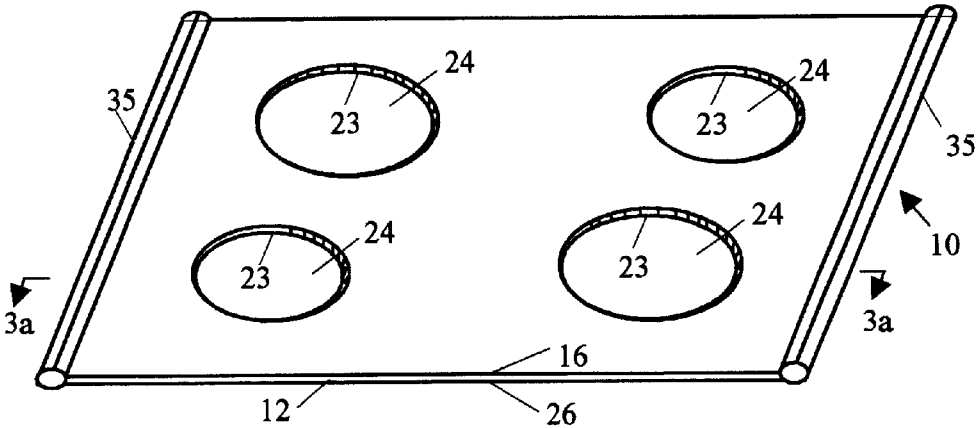
FIG. 3 is a perspective view of a further alternative cooktop hygiene device.
Figure 3B:
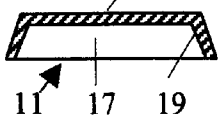
FIG. 3*b* is a sectional view of a removable cover for use with cooktop hygiene device of FIG. 3.
Figure 3A:
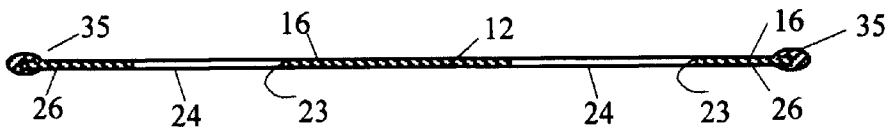
FIG. 3*a* is a sectional view along line 3*a*—3*a* of FIG. 3.

FIGS. 3 and 3*a* shows another modified version of the cooktop hygiene device of FIG. 1. This modified device can also be manufactured from flexible sheet or film or woven cloth materials by simple processes such as die cutting. Two elongated support members 35 are located at the left and right ends of the plate-like structure 12 to facilitate the handling of the flexible plate-like structure, thus facilitating the handling, washing and storage of the cooktop hygiene device. The elongated support member can be a bar, rod, strip, beam or tube and can be mechanically or thermally attached to the plate-like structure 12. The elongated support member can also be formed by rolling or flanging the plate-like structure if the plate-like structure is made of metal or alloy (e.g. aluminum or stainless steel) film, sheet or cloth. The elongated support member 35 can be configured to apply force(s) or tension to the plate-like structure 12 to prevent it from free movement on the cooktop surface. For examples, the support member 35 may comprise magnet, mechanical lock or adhesive to cause itself to attach to the cooktop, therefore limiting the movement of the plate-like structure. The elongated support members 35 on both ends of the plate-like structure may be weight bars, rods or tubes hanging on the corresponding sides of the cooktop to tension the plate-like structure 12, therefore limiting the movement of the plate-like structure on the cooktop. The elongated support member 35 can also be configured to cause the plate-like structure, if made of flexible film, sheet or woven cloth, to conform to the contour of the cooktop surface. For example, if the cooktop hygiene device is designed for the cooktop of FIG. 1, the elongated support member can have a downward extension to push the center portion of the flexible plate-like structure to the recessed cooktop surface 93*a* and have two ends to push the front and back ends of the flexible plate-like structure to a raised peripheral surface 93*b* of the cooktop.

FIG. 3*b* shows a removable heater cover 11 having a chamber 17 for receiving the heater 91 of the cooktop for use with this modified cooktop hygiene device. A flat heater cover 11 like that in FIG. 2 can also be used with this device, especially if the cooktop is a glass/ceramic smooth-top cooktop or range. If desired, the heater cover can be connected to the plate-like structure with hinge 21.

Figure 3C:
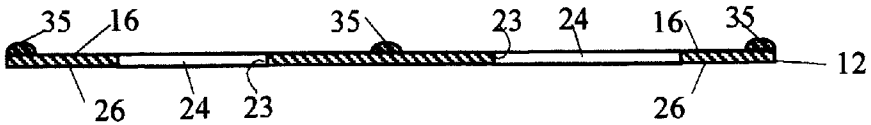
FIG. 3*c* shows a modified version of the cooktop hygiene device of FIG. 3.

FIG. 3*c* shows a third elongated support member 35 positioned near the center of the plate-like structure 12 to further facilitate the handling (e.g. folding or rolling) of the plate-like structure 12. It is appreciated more than three or fewer than two elongated support members 35 may be attached or formed at the plate-like structure. The elongated support member may be un-necessary if the plate-like structure 35 is thick or strong enough to be handled readily.

Figure 3E:
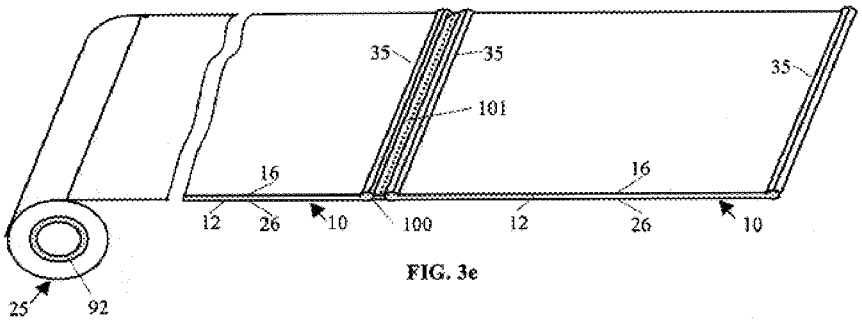
FIG. 3*e* shows a plurality of cooktop hygiene devices rolled on a core.

FIG. 3*e* shows a plurality of cooktop hygiene devices 10 that are wound on a core 92 to form a roll 25. Each cooktop hygiene device 10 in the roll 25 comprises a flexible plate-like structure 12 having an upper surface 16 for collecting the food and liquid spillings or sputterings and a lower surface for interfacing with the surface of the cooktop. The flexible plate-like structure 12 has approximately the same dimension, i.e. width and depth, as the surface of the cooktop to which the cooktop hygiene device is to be mounted. It is generally impermeable to the food and liquid, therefore preventing the food and liquid spillings or sputterings on the upper surface 16 from reaching the lower surface or the cooktop surface. Such impermeable flexible plate-like structure may be made of heat-resistant, non-flammable film, foil, sheet, or woven or non-woven cloth. An elongated support member 35 can be attached to or formed at each end of the flexible plate-like structure 12 to facilitate the handling of the cooktop hygiene device. (More or fewer than two elongated support members 35 can be attached to or formed on each cooktop hygiene device). The cooktop hygiene devices 10 in the roll 25 are joined to one another by joint strip 100 having a perforated line 101 to facilitate the removal of the device from the roll 25. Alternately, the cooktop hygiene devices in the roll 25 may be wounded as separate entities without any joint between the devices. The cooktop hygiene devices in the roll 25 may also be separated from each other by a simple perforated line or by a line mark and be removed from the roll by tearing along the perforated line or cutting with a cutter along the line mark. Such method of packaging cooktop hygiene devices can be used for other cooktop hygiene devices having plate-like structures 12 that are flexible.

Figure 3F:
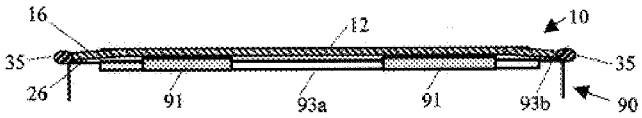
FIG. 3*f* shows one of the cooktop hygiene devices of FIG. 3*e* mounted on a cooktop.

FIG. 3*f* shows a cooktop hygiene device 10, similar to those in FIG. 3*e*, mounted to the cooktop 90. The plate-like structure 12 of the device covers the heaters 91 and cooktop surface. In one embodiment, the plate-like structure 12 is made of highly heat-resistant materials such as stainless steel, high-temperature aluminum alloy, glass and ceramic materials. Such plate-like structure 12 can survive over direct or close contact with the heaters 91. To prepare food, the user simply places the cookware or utensil on the area of the plate-like structure that is directly above a heater 91, i.e. on the cooking zone of the plate-like structure. The cooking zone conducts heat from the heater to the cookware or utensil. To indicate to the user the precise location of each heater 91 below the cooktop hygiene device, certain heat resistant marks (e.g. a circle or radiant lines) may be printed or formed on the cooking zones of the plate-like structure. The plate-like structure can also be made transparent or translucent to let the user see through the plate-like structure to locate the heaters. Small holes, in the range of approximately 0.0001" to 0.1" (preferably 0.01" to 0.1"), may be formed on the plate-like structure let the user see through the plate-like structure to locate the heaters without letting any significant amount of food or liquid spillings or sputterings pass through the plate-like structure.

The cooktop hygiene devices 10 of FIG. 3*f* can be used for conventional electric or gas cooktops or ranges. For gas cooktop, a plurality of air vents such as holes can be formed on the plate-like structure 12 to supply air to the gas heaters. The cooktop hygiene device 10 can also be used for glass/ceramic smooth-top range. To reduce potential damage of the plate-like structure 12 by the heaters 91, the plate-like structure or only the sections of the plate-like structure that are directly above the heaters, i.e. the cooking zones, can be configured to increase the surface area, therefore increasing the rate of heat transfer from the cooking zones to the surroundings. The surface area of the plate-like structure or the cooking zones can be increased, for example, by forming raised or recessed structures such as discs, ridges or cells on the upper surface of the plate-like structure 12 or the cooking zones.

Figure 3G:
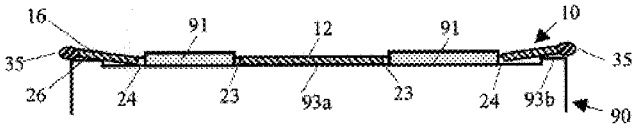
FIG. 3*g* shows the forming of the openings for a cooktop hygiene device of FIG. 3*e* on a cooktop.

In another embodiment of the cooktop hygiene device 10 of FIG. 3*f*, the plate-like structure 12 is made of material(s) that is heat-resistant, but not resistant enough to withstand the heat from direct or close contact with the heaters 91 of the cooktop. Examples of such materials include low-temperature aluminum alloy, Teflon, Kevlar, silicone rubber and other materials that are inherently non-flammable or can be blended with flame-retardant additives. After the cooktop hygiene device is mounted onto the cooktop 90 as shown in FIG. 3*f* and after the heaters 91 are turned on, the heater temperature raises quickly to the melting point or decomposition point of the plate-like structure. The regions on the plate-like structure which are directly on the heaters 91 and sufficiently close to the heaters become melted, decomposed, burned or evaporated by the high temperature of the heaters. As a result, openings 24 having approximately the size of the corresponding heaters 91 are formed or partially formed in the plate-like structure for the heaters 91 on the cooktop 90 (refer to FIG. 3*g*). The openings 24 allow the user to place cookware or utensil directly on or above the heaters 91. By forming or partially forming the openings 24 for the plate-like structure 12 directly on the cooktop 90, the consumers do not need to spend the effort to select the cooktop hygiene devices with the right openings 24 to match the size, shape and position of their cooktops.

Figure 3H:
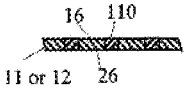
FIGS. 3*h* to 3*j* shows several alternate plate-like structures 12 having anisotropic heat conductivity.
Figure 3I:
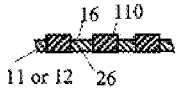
Figure 3J:
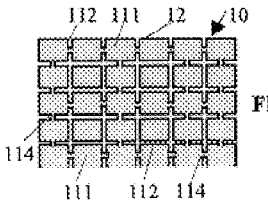

The plate-like structure 12 and heater cover 11 of FIGS. 1 to 10 can be made of anisotropic material(s) that has high heat conductivity across the thickness of the plate-like structure or heater cover but low heat conductivity along the surface of the plate-like structure or heater cover. An example of such anisotropic materials is a film or sheet having conductive entities 110 such as particles, beads, plates, discs or short wires dispersed, either randomly or regularly, in the film or sheet. The concentration of such conductive entities in the film or sheet can be sufficiently low to reduce direct contact between adjacent conductive entities along the surface. To achieve significant increase in conductivity across the thickness of the plate-like structure or heater cover, the dimension of the conductive entities is at least approximately ⅛, preferably at least ⅓, of the thickness of the plate-like structure or heater cover. FIGS. 3*h* and 3*i* show part of a plate-like structure 12 or heater cover 11 in which conductive entities 110 having dimensions equal to and greater than the thickness of the plate-like structure or heater cover are used, respectively. Another example of such anisotropic materials is a film, sheet, plate or woven cloth having air gaps between the solid pieces. The solid pieces can be miniature plates, rings, strips, wires, discs, etc. The solid pieces themselves can be porous or nonporous. The solid pieces are connected to each other by narrow connectors strips or lines sufficiently narrow or thin to minimize the heat conduction between the solid pieces. The air gaps between the solid pieces may be filled with heat insulation materials to prevent the food or liquid spillings or sputterings on the upper surface 16 from passing through the gaps to the lower surface 26 of the plate-like structure 12. The air gaps can also be made narrow or small enough to prevent the food or liquid spillings or sputterings from penetration. FIG. 3*j* shows part of a plate-like structure made of numerous small thin plates 111 separated from each other by air gaps 112 and connected to each other by narrow connectors 114. The air gaps 112 can be small enough or can be filled with heat insulation material to prevent the food or liquid spillings or sputterings from passing through the plate-like structure. The materials for the solid pieces such as miniature plates, rings, strips, wires, discs and the arrow connectors such as narrow strips or lines can be stainless steel, aluminum or its alloy, steel, and other structurally durable materials. It is appreciated that such anisotropic materials can also be used for the heater covers 11.

Figure 4:
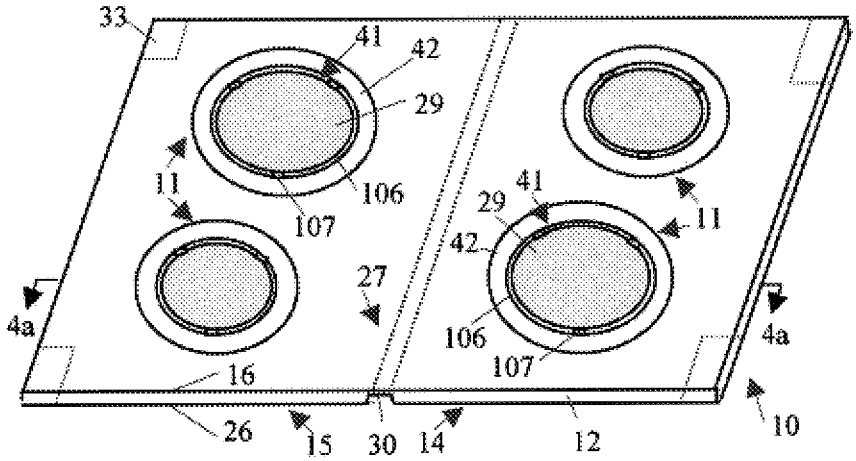
FIG. 4 is a partly perspective, partly top view of a further alternative cooktop hygiene device
Figure 4A:
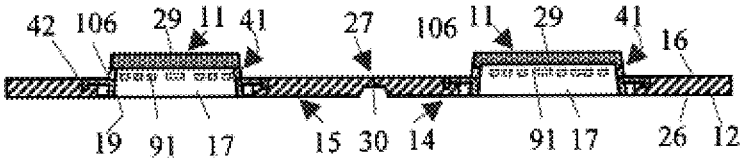
FIG. 4*a* is a sectional view along line 4*a*—4*a* of FIG. 4.

FIGS. 4 and 4*a* show another alternative to the cooktop hygiene device 10 of FIG. 1. In the alternative cooktop hygiene device, the heater covers 11 are attached to the plate-like structure 12 via the peripheral extension 42 of the heater covers. A heat-restriction ring 41 is formed between the peripheral extension 42 and the top wall 29 of the heater cover 11 to enable a large temperature drop from the top wall 29 to the peripheral extension 42 when the heater 91 is on (FIG. 4*a*). The heat-restriction ring 41 comprises a plurality of air gaps 106 and a plurality of narrow connectors 107 (FIG. 4 shows three air gaps and three narrow connectors). The construction allows the top wall 29 of the heater cover to become the cooking zone and conducts heat from the heater 91 received in chamber 17 of the heater cover 11 to the cookware or utensil on the top wall 29. It also makes the upper surface 16 of the plate-like structure 12 feel cool. To withstand temperatures up to that of the heater 91, the heater cover 11 is made of highly heat resistant materials(s) such as stainless steel, cast iron, glass or ceramic materials. The air gaps 106 may be made larger to function also as the vents to provide sufficient air to the burners if the cooktop hygiene device is mounted to a conventional gas cooktop or range.

The air gaps 106 can be made very narrow to prevent the food and liquid sputterings or spillings from passing through. The air gaps can also be filled with heat-insulation materials to prevent the food and liquid sputterings or spillings from passing through. More than one heat-restriction ring 41 may be formed between the top wall 29 of the heater cover, i.e. the cooking zone, and the plate-like structure 12. It is also appreciated that such heat-restriction rings can be formed throughout the heat cover and the plate-like structure.

Figure 5:
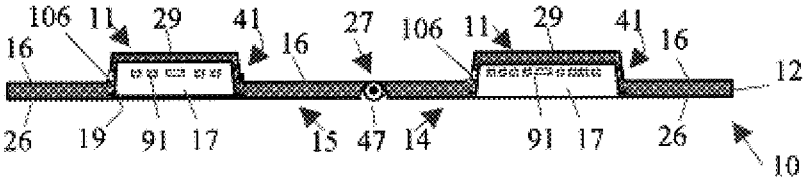
FIGS. 5 to 5*c* are sectional views for the alternatives to the cooktop hygiene device of FIG. 4.
Figure 5A:
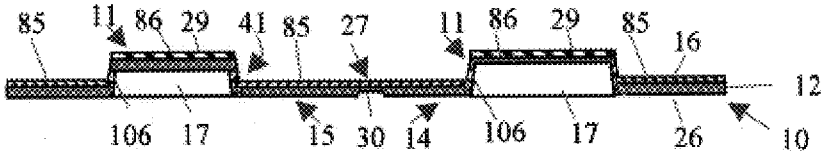
Figure 5B:
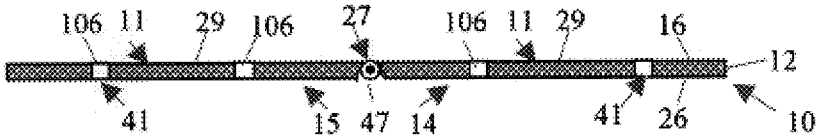
Figure 5C:
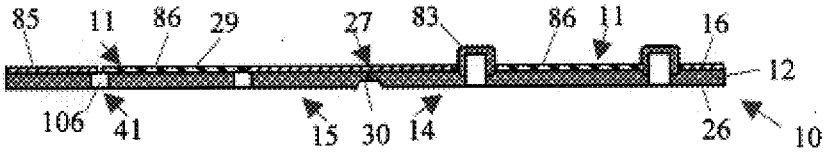

FIG. 5 shows a modified version of the cooktop hygiene device 10 of FIG. 4. In FIG. 5, the plate-like structure 12 is made of the same highly heat-resistant materials(s) as the heater covers 11. The heater cover 11 and the plate-like structure 12 are connected via heat restriction zone 41. The left part 15 and right part 14 of the plate-like structure are connected by the fold facilitator 27 comprising a hinge 47 to allow the cooktop hygiene device to fold to fit into a conventional dishwasher. FIG. 5*a* shows a modified version of the cooktop hygiene device 10 of FIG. 5. In this modified cooktop hygiene device, the top surface 16 of the plate-like structure 12 is coated with coating 85 such as Teflon or Silicone rubber and the top wall 29 (i.e. the cooking zone) of the heater cover 11 is coated with an inert, highly heat-resistant materials such as glass or ceramic materials. FIG. 5*b* shows another modified version of the cooktop hygiene device of FIG. 5 in which the heater covers 11 are flat discs connected to the plate-like structure 12 via heat restriction zone 41. The heater cover 11, as the cooking zone, conducts heat from the heater 91 of the cooktop 90 to the cookware or utensil siting on the wall 29 of the heater cover. Numerous spaced-apart conductive objects such small metal bars or discs may be dispersed in the heater covers 11 and plate-like structure 12 to increase the heat conduction from the lower surface 26 to upper surface 16 drastically without impacting the heat conduction along the surface to any significant degree, therefore making the plate-like structure anisotropic. FIG. 5*c* shows a modified version of the cooktop hygiene device of FIG. 5*b* in which at least one of the heater covers 11 is surrounded by a raised wall 83 to form a pan 87 for the user to cook or prepare food therein. The top wall 29 of the heater covers 11 can be coated with inert, heat resistant coatings such as Teflon, glass or ceramic materials. The upper surface 16 of the plate-like structure 12 can be coated with heat-resistant polymer such as Teflon or polyimide, rubber material such as silicone, glass or ceramic material.

It is appreciated the heater covers 11 can be made of heat conductive and durable materials such as stainless steel, cast iron and steel to increase the efficiency of conducting heat from heaters 91 across the top wall 29 to the cookware or cooking utensil. Various heat restriction mechanisms such as heat restriction zone 41, ultra-thin wall thickness and anisotropic materials may be used to decrease the heat conduction rate from the cooking zones to the rest of the cooktop hygiene device.

Figure 6:
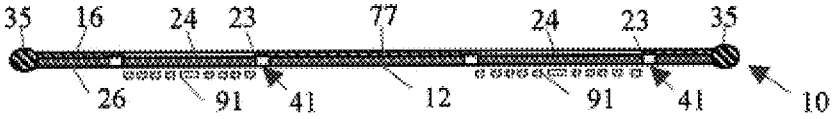
FIGS. 6 and 6*a* are section views of further alternatives to the cooktop hygiene device of FIG. 4.

FIG. 6 shows another alternative to the cooktop hygiene device of FIG. 1. This alternative cooktop hygiene device comprises a highly heat-resistant, flexible or foldable sheet 12 such as a woven or non-woven cloth made of metal, glass or ceramic fibers or a thin film made of heat-resistant metal, glass or ceramic materials. This heat-resistant, flexible or foldable sheet is comparable to plate-like structure 12 in the earlier examples. Preferably, the fibers or materials(s) used for the flexible or foldable sheet 12 can withstand temperatures higher than 1000° F. so that it may not be significantly damaged upon close contact with the heaters 91 of the cooktop 90. A coating layer 77 may be applied to the upper surface 16 of the flexible or foldable sheet 12 in such a way that openings 24 surrounded by peripheral wall 23 are formed at predetermined locations on the flexible or foldable sheet. The openings 24 are dimensioned and positioned on the flexible or foldable sheet in such a way that the heaters 91 on the cooktops are directly below the openings 24 and approximately within the peripheral wall 23 of the openings after the cooktop hygiene device is mounted onto the cooktop 90. The opening 24 allows a cookware or utensil to be placed directly on the area of the flexible or foldable sheet surrounded by peripheral wall 23 or the cooking zone, thereby increasing the heat conduction rate from the heater to the cookware. The coating layer 77 is made of heat resistant material(s) such as Teflon, Silicone, ultra-thin glass or ceramic materials. To facilitate the folding or rolling of the flexible or foldable sheet 12, elongated support members 35 (similar to that in FIGS. 3–3*c*) are attached to or formed at the left and right ends of the flexible or foldable sheet 12.

Figure 6A:
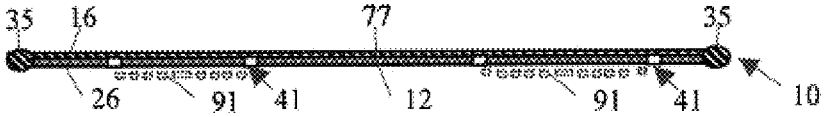

FIG. 6*a* shows a modified version of the cooktop hygiene device 10 of FIG. 6. In this modified cooktop hygiene device, the coating layer 77 completely covers the upper surface 16 or the flexible or foldable plate-like structure 12. The coating 77, in one embodiment, is resistant to the high temperature caused by the heaters 91 and will stay intact during the use of the cooktop hygiene device on the cooktop. The cooking zones on the plate-like structure are the sections of the plate-like structure 12 that are directly above the heaters 91. Examples of such highly heat-resistant coating materials are glass and ceramic materials. In another embodiment, the coating 77 is heat-resistant but is not heat-resistant enough to withstand the high temperature on the heater 91. Examples of such limited heat resistant coating materials are Teflon, silicone rubber, epoxy thermosets, and other polymers with or without flame-retardant additives. The preferred materials are those that release no harmful substances when exposed to high heat and are not flammable. After the cooktop hygiene device is mounted to the cooktop and the heaters are turned on, those regions of the coating 77 on the plate-like structure 12 which are directly above the heaters 91 may be burned, melted or evaporated by the high temperature caused by the heaters. One opening 24 having approximately the size of the corresponding heater 91 is formed in the coating 77 on the plate-like structure for each heater 91 on the cooktop 90. As a result, the cooktop hygiene device of FIG. 6*a* is converted into that of FIG. 6. Since the heaters 91 in different cooktops may have different sizes, shapes and positions, it is somewhat difficult for consumers to select the right cooktop hygiene devices with the right openings 24 for their cooktops. This method of forming the openings 24 directly on the cooktop makes the selection process much easier since a user does not need to get a cooktop hygiene device with the right openings 24 to match the heaters on the user's cooktop.

It is appreciated that the plate-like structure 12 may be a porous plate such as a metal film or sheet containing numerous punched holes, a woven or non-woven cloth made of fibers such as thin stainless steel or glass fibers, and a porous metal or ceramic film. The coating 77 can be within the pores or gaps of the porous plate, on one surface of the porous plate, on both surfaces of the porous plate, both within the pores or gaps and on one surface of the porous plate, or both within the pores or gaps and on both surfaces of the porous plate. In all cases, the coating 77 on or in the porous plate regions that are directly above the heaters 91 is burned, melted or evaporated by the high temperature caused by the heaters. As a result, only the part of the porous plate that is away from the heaters remain coated with coating 77.

Figure 7:
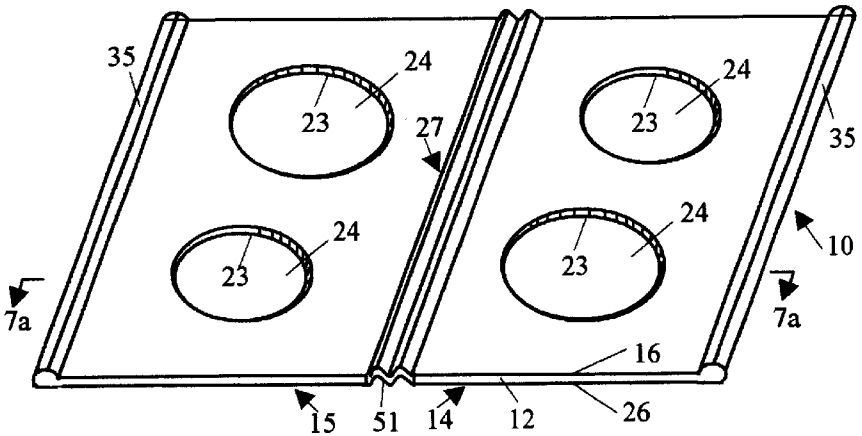
FIG. 7 is a perspective view of a still further alternative to the cooktop hygiene device of FIG. 1.
Figure 7A:
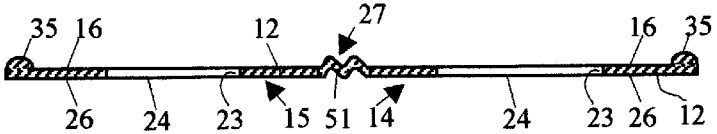
FIG. 7*a* is a sectional view along line 7*a*—7*a* of FIG. 7.
Figure 7B:
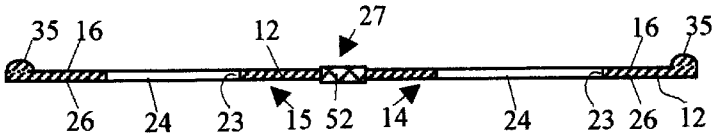
FIGS. 7*b* and 7*c* are sectional views for the modified versions of the cooktop hygiene device of FIG. 7 having a different connectors 27.
Figure 7C:
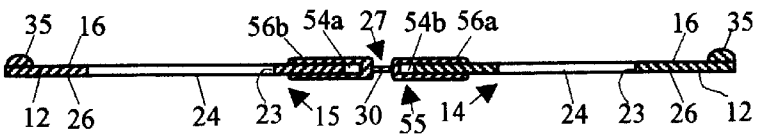

FIGS. 7 and 7*a* show a modified version of the cooktop hygiene devices 10 of FIGS. 2 and 3. In this modified cooktop hygiene device, the folding facilitator or connector 27 comprises an expandable member such as a corrugated or pleated section 51 that can be elongated or shortened by stretching or compressing. Such connector 27 enables the user or consumer to adjust the distance between the two openings on the left plate-like member 15 of the plate-like structure 12 and the two openings on the right plate-like member 14 to fit to his or her cooktop. The folding facilitator or connector 27 in FIG. 7*b* comprises a section of expandable material 52 having shish-kabab or row-lamellar structure. Examples of such expandable material include semi-crystalline polymers such as polypropylene and fibrous materials such as expanded Teflon. The expandable material 52 allows the user to increase the distance between the openings on the left member and the openings on the right member 14 of the plate-like structure 12 to fit to his or her cooktop. The folding facilitator or connector 27 in FIG. 7*c* comprises a mechanical connector 55 comprising a left claw 56*b* with a thin chamber 54*a* to receive a small portion of the left plate-like member 15 of the plate-like structure 12, a right claw 56*a* with a thin chamber 54*b* to receive a small portion of the right plate-like member 14 of the plate-like structure 12, and a flexible or foldable section 30 for connecting the left and right claws. To change the distance between the openings on the left part 15 and right part 14 of the plate-like structure 12, the user simply pulls or pushes the left part 15 or/and right part 14 out of or into the thin chambers of the mechanical connector 55. It is appreciated that the flexible or foldable section 30 of the mechanical connector 55 may not be needed since the dimension of the cooktop hygiene device may be reduced enough to fit into a dishwasher by pushing the left and right plate-like members into the thin chambers 54*a* and 54*b*.

Figure 8:
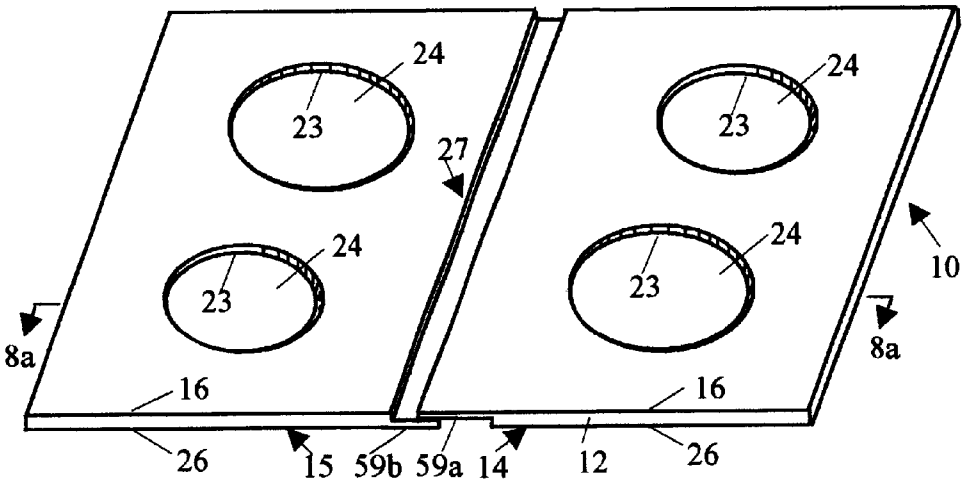
FIG. 8 is a perspective view of a still further alternative to the cooktop hygiene device of FIG. 1.
Figure 8A:
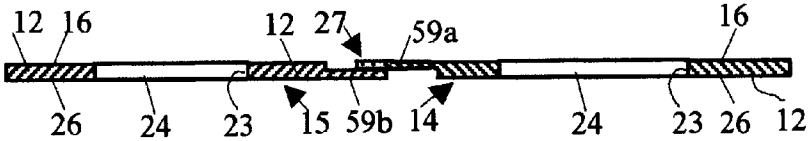
FIG. 8*a* is a sectional view along line 8*a*—8*a* of FIG. 8.
Figure 8B:
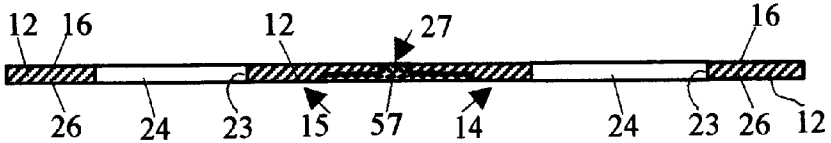
FIG. 8*b* is a sectional view for a modified version of the cooktop hygiene device of FIG. 8 with a different connector 27.

FIGS. 8 and 8*a* show another modified version of the cooktop hygiene device 10 of the earlier exemplar embodiments. The connector 27 of this modified cooktop hygiene device comprises a first connection plate 59*b* located at the left part 15 and a second connection plate 59*a* located at the right part 15 of the plate-like structure 12. The first and second connection plates 59*b* and 59*a* are dimensioned to match each other to make a smooth connection when the two connection plates are placed over each other. The connection plates 59*a* and 59*b* can be part of the right and left parts 14 and 15 of the plate-like structure 12, respectively. Since the right and left parts 14 and 15 of the plate-like structure 12 can be readily separated from each other, to wash the cooktop hygiene device the user removes the left and right parts of the plate-like structure 12 as separate pieces, each of which is small enough to carry and fit into a conventional dishwasher, and place each part into the dishwasher. FIG. 8*b* shows another modified cooktop hygiene device where the right and left parts 14 and 15 of the plate-like structure 12 are connected by a flexible piece of material 57. Suitable materials for the flexible piece of material 57 include elastomers such as silicone or nitrile rubber, plastic film or thin metal film. The flexible piece of material allows the folding of the plate-like structure 12 to fit into a conventional dishwasher.

Figure 9:
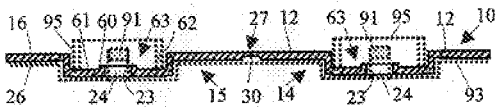
FIG. 9 is a sectional view of a still further alternative cooktop hygiene device and part of a cooktop shown in dotted lines.
Figure 9A:
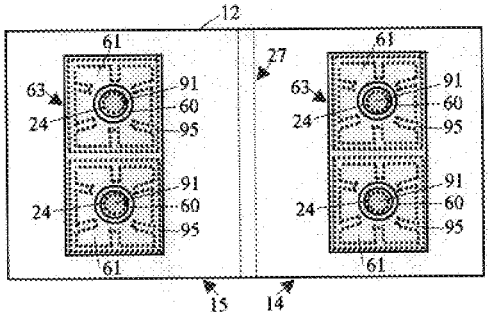
FIG. 9*a* is a top view of the cooktop hygiene device and part of a cooktop of FIG. 9.

FIGS. 9 and 9*a* show another modified version of the cooktop hygiene device 10 of FIG. 1. This modified cooktop hygiene device is best suited for gas ranges having a cooktop surface 93 (shown in dotted lines in FIG. 9). It comprises two rectangular drip pans 63, one on the left part 15 and the other on the right part 14 of the plate-like structure 12. Each rectangular drip pan 63 is positioned below two heaters 91 for receiving food and liquid spillings or sputterings from the cookwares or utensils supported on the cookware supports such as grates 95 (in dotted lines in both FIGS. 9 and 9*a*). Each rectangular drip pan 63 comprises a bottom 61, two openings 24 formed on the bottom 61 for receiving the two heaters 91, and a side wall 62 for connecting the bottom 61 to plate-like structure 12. A raised peripheral wall 60 is formed around each opening 24 to prevent the solid and liquid spillings from falling out of the drip pan. It is appreciated that the cooktop hygiene device may comprise one drip pan, either square or circular depending on the configuration of the cooktop, for each heater 91. It is also appreciated that the cooktop hygiene device may comprise two or four heater covers 11 (not shown) for covering the heaters 91 and the cookware supports 95.

Figure 10:
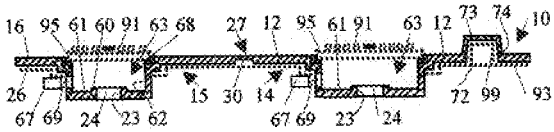
FIG. 10 is a sectional view of a even still further alternative cooktop hygiene device and part of a cooktop shown in dotted lines.
Figure 10A:
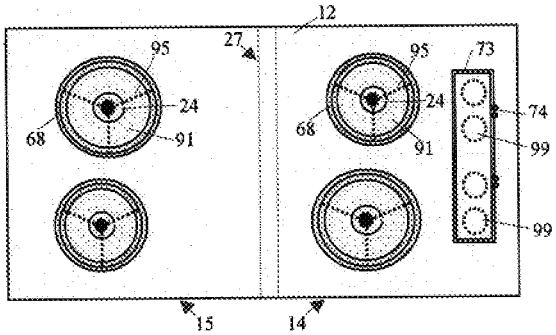
FIG. 10*a* is a top view of the cooktop hygiene device and part of a cooktop of FIG. 10.

FIGS. 10 and 10*a* show another modified version of the cooktop hygiene device 10 of FIG. 1. This modified cooktop hygiene device is best suited for electric ranges having a cooktop surface 93 (shown in dotted lines in FIG. 10). It comprises four drip pans 63, two on the left part 15 and the other two on the right part 14 of the plate-like structure 12. Each drip pan 63 is positioned below a heater 91 for receiving the food and liquid spillings or sputterings from the cookwares or utensils on the heaters. Each drip pan 63 comprises a bottom 61, a side wall 62 for connecting the bottom 61 to plate-like structure 12, and an optional opening 24 having an inner wall 23 formed on the bottom 61. A raised wall 60 is formed around the opening 24 to prevent the solid and liquid spillings from falling out of the drip pan. A ring-like structure 68 may be located around the upper end of the drip pan 63 for insulating the heater support 95 (shown in dotted lines in FIGS. 10 and 10*a*) from the drip pan. A plurality of openings 68 are formed on the side wall 62 of each drip pan 63 so that at least one of the openings 68 will face the electrical socket 67 for the corresponding heater, thereby allowing the electrical plug (not shown) for the heater to pass this opening and plug into the socket. It is appreciated that the drip pans 63 can be used to replace the existing drip pans in a cooktop or be positioned above the existing drip pans.

A rectangular opening 72 is formed on the plate-like structure 12 for receiving the control knobs 99 (shown in dotted lines in FIGS. 10 and 10*a*) on the cooktop surface 93. A control panel cover 73 is connected to plate-like structure 12 with a hinge 74 for covering the control knobs. The control knob cover prevents food and liquid spillings or sputterings from contaminating the control knobs for the cooktop and possibly oven, thus reducing the need to clean the difficult to reach knobs. It is appreciated that the control knobs 99 for a cooktop or a combined cooktop/oven range may be located on other location of the cooktop such as on the surface of a raised wall near the back of the cooktop or on the surface of the front wall. The plate-like structure 12 of the cooktop hygiene device 10 can be extended to cover part of or all the surface of the raised wall or the front wall of the cooktop and to allow the control knob cover 73 to cover the control knobs on such surface.

The scope of the invention is obviously not restricted to the various embodiments described by way of examples and depicted in the drawings, there being numerous changes, modifications, combinations, additions, and applications thereof imaginable within the purview of the claims.

What is claimed is:

1. A cooktop hygiene device for use with a cooktop or stove having a plurality of heaters, said cooktop hygiene device comprising:

a plate-like structure removably mountable to the cooktop or stove for preventing food and liquid spillings or sputterings from contaminating the cooktop or stove, said plate-like structure comprising a first surface adapted to receive food and liquid spillings or sputterings from cookware or utensil during food preparation process, a second surface adapted to face the surface of the cooktop or stove, a plurality of openings located on said plate-like structure to allow the heaters of the cooktop or stove to be accessible so that a user can place a cookware or utensil on or above a heater of the cooktop or stove for heating the content in the cookware or utensil when the cooktop hygiene device is mounted to the cooktop or stove;

a heater cover for one of said plurality of openings; and a hinge for connecting said heater cover to said plate-like structure and for allowing a user to turn or move said heater cover to open or close said opening.

2. A cooktop hygiene device as defined in claim 1 further comprising a second heater cover for a second opening of said plurality of openings, a second hinge for connecting said second heater cover to said plate-like structure, a third heater cover for a third opening of said plurality of openings, and a third hinge for connecting said third heater cover to said plate-like structure.

3. A cooktop hygiene device as defined in claim 1 wherein said hinge includes an extension for positioning said heater cover sufficiently away from the heater when said heater cover is turned away from said opening to make the heater accessible.

4. A cooktop hygiene device as defined in claim 1 wherein said hinge is adapted to allow said heater cover to be turned to close or open said opening on said plate-like structure.

5. A cooktop hygiene device as defined in claim 1 wherein said hinge comprises a flexible member adapted to allow said heater cover to turn or move for opening or closing said opening.

6. A cooktop hygiene device as defined in claim 1 wherein said hinge comprises an attachment connecting said heater cover to said plate-like structure for allowing said heater cover to turn to open or close said opening.

7. A cooktop hygiene device as defined in claim 1 further comprising a lock mechanism such as a catch/latch mechanism, magnet mechanism, adhesion mechanism or frictional engagement mechanism for limiting or preventing the movement of said heater cover relative to said plate-like structure.

8. A cooktop hygiene device as defined in claim 1 wherein said opening comprises a raised periphery for preventing the food or liquid spillings or sputterings from leaving said first surface of said plate-like structure.

9. A cooktop hygiene device as defined in claim 1 wherein said heater cover comprises a heat conductive plate adapted to engage with the heater for conducting heat to cookware or food thereon.

10. A cooktop hygiene device as defined in claim 1 wherein said heater cover comprises a top wall, a side wall and a chamber defined by said walls.

11. A cooktop hygiene device as defined in claim 1 wherein said heater cover is adapted to be substantially flat.

12. A cooktop hygiene device as defined in claim 11 wherein said hinge is adapted to allow said heat cover to be turned substantially vertically or horizontally to close or open said opening.

13. A cooktop hygiene device as defined in claim 1 wherein said plate-like structure is made from substantially rigid sheet material such as stainless steel sheet, ceramic sheet, glass sheet, metal sheet, high-temperature plastic sheet or any combination.

14. A cooktop hygiene device as defined in claim 1 wherein said plate-like structure is adapted to be flexible.

15. A cooktop hygiene device as defined in claim 14 further comprising at least one elongated support member connected to said plate-like structure to facilitate the handling of said device.

16. A cooktop hygiene device as defined in claim 1 wherein said plate-like structure comprises a substantially rigid left-hand plate-like structure containing some of said plurality of openings, a substantially rigid right-hand plate-like structure containing some of said plurality of openings, the upper surfaces of said left-hand and right-hand plate-like structures constituting said first surface and the lower surfaces of said left-hand and right-hand plate-like structures constituting said second surface, and a structure connector for connecting said substantially rigid left-hand and right-hand plate-like structures.

17. A cooktop hygiene device as defined in claim 16 wherein said structure connector is adapted to allow said left-hand and right-hand plate-like structures to be combined in such a way that said lower surfaces of said left-hand and right-hand plate-like structures, which are free of food or liquid spillings or sputterings, become faced to each other, and said upper surfaces of said left-hand and right-hand plate-like structures, which are contaminated by the food or liquid spillings or sputterings, are exposed after said left-hand and right-hand plate-like structures are folded or combined, thereby facilitating the washing or removal of the food or liquid spillings or sputterings.

18. A cooktop hygiene device as defined in claim 17 wherein said substantially rigid left-hand and right-hand plate-like structures are dimensioned to enable the combined or folded left-hand and right-hand plate-like structures to fit into a dishwasher to be washed or cleaned automatically.

19. A cooktop hygiene device as defined in claim 1 further comprising a plurality of drip pans connected to said plate-like structure, said drip pans being adapted to be positioned below the electric or gas heaters for catching food and liquid spillings or sputterings from said openings.

20. A cooktop hygiene device for use with a cooktop or stove having a plurality of heaters, said cooktop hygiene device comprising:

a plate-like structure removably mountable to the cooktop or stove for preventing food and liquid spillings or sputterings from contaminating the cooktop or stove, said plate-like structure comprising a first surface adapted to receive food and liquid spillings or sputterings from cookware or utensil during food preparation process, a second surface adapted to face the surface of the cooktop or stove, a plurality of openings located on said plate-like structure to allow the heaters of the cooktop or stove to be accessible so that a user can place a cookware or utensil on or above a heater of the cooktop or stove for heating the content in the cookware or utensil when the cooktop hygiene device is mounted to the cooktop or stove;

a heater cover for one of said plurality of openings; and a lock mechanism for locking said heater cover to said plate-like structure to facilitate the handling and washing of said cooktop hygiene device.

21. A cooktop hygiene device as defined in claim 20 wherein said lock mechanism comprises a catch and latch.

22. A cooktop hygiene device as defined in claim 20 wherein said lock mechanism comprises a magnet.

23. A cooktop hygiene device as defined in claim 20 wherein said lock mechanism comprises a snagged or frictional engagement between said heater cover and said plate-like structure or opening.

24. A cooktop hygiene device as defined in claim 20 wherein said lock mechanism comprises an adhesive.

25. A cooktop hygiene device as defined in claim 20 wherein said heater cover comprises a top wall, a side wall and a chamber defined by said walls.

26. A cooktop hygiene device as defined in claim 25 wherein said top wall is heat-conductive plate and is adapted to engage with the heater for conducting heat to cookware or food thereon.

27. A cooktop hygiene device as defined in claim 25 wherein said side wall constitutes said lock mechanism, said side wall having a lower end connected to said plate-like structure around the periphery of said opening.

28. A cooktop hygiene device as defined in claim 27 wherein said side wall comprises at least one opening located between said top wall and said plate-like structure for venting said chamber and making air sufficiently available to the heater.

29. A cooktop hygiene device as defined in claim 1 wherein said plate-like structure comprises a substantially rigid left-hand plate-like structure containing some of said plurality of openings, a substantially rigid right-hand plate-like structure containing some of said plurality of openings, the upper surfaces of said left-hand and right-hand plate-like structures constituting said first surface and the lower surfaces of said left-hand and right-hand plate-like structures constituting said second surface, and a structure connector for connecting said substantially rigid left-hand and right-hand plate-like structures.

30. A cooktop hygiene device as defined in claim 29 wherein said structure connector is adapted to allow said left-hand and right-hand plate-like structures to be combined in such a way that said lower surfaces of said left-hand and right-hand plate-like structures, which are free of food or liquid spillings or sputterings, become faced to each other, and said upper surfaces of said left-hand and right-hand plate-like structures, which are contaminated by the food or liquid spillings or sputterings, are exposed after said left-hand and right-hand plate-like structures are folded or combined, thereby facilitating the washing or removal of the food or liquid spillings or sputterings.

31. A hygienic cooktop system in which the cooktop or stove can be maintained in a clean or hygienic condition, said hygienic cooktop system comprising:

a cooktop surface;

a plurality of electric or gas heaters on or at said cooktop surface; and a cooktop hygiene device adapted to be removably mountable to said cooktop or stove, said cooktop hygiene device comprising a plate-like structure having a first surface for receiving food and liquid spillings or sputterings from cookware or utensil during food preparation process and a second surface adapted to face the cooktop surface, said plate-like structure being generally impermeable to the food and liquid spillings or sputterings collected on said first surface thereby preventing the food and liquid spillings or sputterings from contaminating said cooktop surface, and openings for receiving said heaters on or at said cooktop surface;

heater covers for said heaters; and hinges for connecting said heater covers to said plate-like structure.

32. A hygienic cooktop system as defined in claim 31 further comprising a plurality of drip pans secured to said plate-like structure, said drip pans being positioned below said electric or gas heaters for catching food and liquid spillings or sputterings from said openings.

33. A hygienic cooktop system as defined in claim 31 further comprising a lock mechanism such as a catch/latch mechanism, magnet mechanism, adhesion mechanism, or frictional engagement mechanism for limiting or preventing the movement of said heater covers relative to said plate-like structure.

34. A hygienic cooktop system as defined in claim 31 wherein said hinge includes an extension for positioning said heater cover sufficiently away from the heater to prevent said heater cover from interfering with access to the heater.

35. A hygienic cooktop system as defined in claim 31 wherein said plate-like structure is manufactured from substantially rigid sheet material such as stainless steel sheet, ceramic, glass, metal, high temperature plastic sheet or any of their combinations.

36. A hygienic cooktop system as defined in claim 31 wherein said plate-like structure includes a substantially inflexible left-hand plate-like structure containing some of said plurality of openings, a substantially inflexible right-hand plate-like structure containing the rest of said plurality of openings, the upper surfaces of said left-hand and right-hand plate-like structures constituting said first surface and the lower surfaces of said left-hand and right-hand plate-like structures constituting said second surface, and a structure connector for connecting said left-hand and right-hand plate-like structures.

37. A hygienic cooktop system as defined in claim 36 wherein said structure connector is adapted to allow said left-hand and right-hand plate-like structures to be combined in such a way that said lower surfaces of said left-hand and right-hand plate-like structures, which are free of food or liquid spillings or sputterings, become facing each other, and said upper surfaces of said left-hand and right-hand plate-like structures, which are contaminated by the food or liquid spillings or sputterings, are exposed after said left-hand and right-hand plate-like structures are folded or combined, thereby enabling the combined or folded substantially rigid left-hand and right-hand plate-like structures to fit into a dishwasher to be washed or cleaned automatically.

38. A cooktop hygiene device for use with a cooktop or stove having a plurality of gas or electric heaters, said cooktop hygiene device comprising:

a left-hand substantially rigid plate-like structure comprising a first upper surface adapted to receive food and liquid spillings or sputterings from cookware or utensil during food preparation process, a first lower surface adapted to face the surface of the cooktop or stove, and at least one opening for allowing a heater of the cooktop or stove to be accessible so that a user can place a cookware or utensil on or above the heater after said device is mounted to the cooktop or stove, said left-hand substantially rigid plate-like structure being generally impermeable to the food and liquid spillings or sputterings collected on said first upper surface thereby preventing the food and liquid spillings or sputterings from reaching said first lower surface;

a right-hand substantially rigid plate-like structure comprising a second upper surface adapted to receive food and liquid spillings or sputterings from cookware or utensil during food preparation process, a second lower surface adapted to face the surface of the cooktop or stove, and at least one opening for allowing a heater of the cooktop or stove to be accessible so that a user can place a cookware or utensil on or above the heater after said device is mounted to the cooktop or stove, said right-hand substantially rigid plate-like structure being generally impermeable to the food and liquid spillings or sputterings collected on said second upper surface thereby preventing the food and liquid spillings or sputterings from reaching said second lower surface;

a structure connector for connecting said left-hand and right-hand substantially rigid plate-like structures, said structure connector being adapted to allow said left-hand and right-hand plate-like structures to be combined in such a way that said first and second lower surfaces, which are free of food or liquid spillings or sputterings, become facing each other and that said first and second upper surfaces, which are contaminated by the food or liquid spillings or sputterings, remain exposed after said left-hand and right-hand plate-like structures are combined or folded, thereby facilitating the washing or removal of the food or liquid spillings or sputterings on said first and second upper surfaces; and a plurality of heater covers for said openings on said left-hand and right-hand substantially rigid plate-like structures.

39. A cooktop hygiene device as defined in claim 38 wherein said left-hand and right-hand substantially rigid plate-like structure is made from substantially rigid sheet material such as stainless steel sheet, ceramic sheet, glass sheet, metal sheet, high-temperature plastic sheet or any combination.

40. A cooktop hygiene device as defined in claim 38 wherein said left-hand and right-hand substantially rigid plate-like structures are dimensioned to enable the combined or folded left-hand and right-hand plate-like structures to fit into a dishwasher to be washed or cleaned automatically.

41. A hygienic cooktop or stove system comprising:

an electric or gas heater, a plate-like structure comprising a first surface for receiving food and liquid spillings or sputterings from cookware or utensil during food preparation process, a second surface opposing said first surface, said plate-like structure being generally impermeable to the food and liquid spillings or sputterings collected on said first surface thereby preventing the food and liquid spillings or sputterings from reaching said second surface, and an opening for receiving said electric or gas heater and allowing a user to place cookware or utensil on or above said electric or gas heater;

a heater cover for said electric or gas heater, and a hinge for connecting said heater cover to said plate-like structure.

42. A cooktop hygiene device as defined in claim 41 wherein said hinge includes an extension for positioning said heater cover sufficiently away from said heater when said heater cover is turned away to open said opening and make the heater accessible.

43. A hygienic cooktop system as defined in claim 4 further comprising a drip pan connected to said plate-like structure, said drip pan being positioned below said opening for catching food and liquid spillings or sputterings.

44. A hygienic cooktop system as defined in claim 41 wherein said plate-like structure is manufactured from substantially rigid sheet material such as stainless steel sheet, ceramic, glass, metal, high temperature plastic sheet or any of their combination.

45. A hygienic cooktop system as defined in claim 41 wherein said plate-like structure comprises a substantially rigid left-hand plate-like structure comprising said opening, a substantially rigid right-hand plate-like structure comprising a second opening for receiving electric or gas heater, the upper surfaces of said left-hand and right-hand plate-like structures constituting said first surface and the lower surfaces of said left-hand and right-hand plate-like structures constituting said second surface, and a structure connector for connecting said substantially rigid left-hand and right-hand plate-like structures.

46. A hygienic cooktop system as defined in claim 45 wherein said plate-like structure is adapted to allow said left-hand and right-hand plate-like structures to be removed from said system and combined in such a way that said lower surfaces of said left-hand and right-hand plate-like structures, which are free of food or liquid spillings or sputterings, become facing each other and that said upper surfaces of said left-hand and right-hand plate-like structures, which are contaminated by the spillings or sputterings, remain exposed after said left-hand and right-hand plate-like structures are folded or combined, thereby facilitating the washing or removal of the spillings or sputterings.

47. A hygienic cooktop system as defined in claim 46 wherein said left-hand and right-hand plate-like structures are dimensioned to enable the folded or combined left-hand and right-hand plate-like structures to fit into a home dishwasher to be washed or cleaned automatically.

48. A method for using hygienic cooktop or stove system as defined in claim 41 comprising removably mounting a plate-like structure to the cooktop or stove system in such a way that the gas or electric heaters are received by the openings on the plate-like structure, turning a heater cover about a hinge that connects the heater cover to the plate-like structure to open an opening and make a heater accessible, placing a cookware or utensil on or above the heater, and collecting liquid or food spillings or sputterings from the cookware or utensil onto the upper surface of the plate-like structure.

49. A method for using a cooktop or stove having at least one electric or gas heater and a cooktop surface comprising:

mounting a plate-like structure onto the cooktop surface in such a way that a gas or electric heater of the cooktop or stove is received by an opening on the plate-like structure;

turning a heater cover about a hinge to make a gas or electric heater received by an opening on the plate-like structure accessible;

placing a cookware or utensil on or above a gas or electric heater of the cooktop or stove; and collecting food or liquid spillings or sputterings from the cookware or utensil onto the upper surface of the plate-like structure.

50. A method for using a cooktop or stove as defined in claim 49 further comprising turning a heater cover about a hinge to close an opening on the plate-like structure and cover the heater received by the opening.

* * * * *